US006195442B1

(12) United States Patent
Griffin et al.

(10) Patent No.: US 6,195,442 B1
(45) Date of Patent: Feb. 27, 2001

(54) PASSIVE VIBROACOUSTIC ATTENUATOR FOR STRUCTURAL ACOUSTIC CONTROL

(75) Inventors: Steven F. Griffin; Steven A. Lane, both of Albuquerque, NM (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/384,901

(22) Filed: Aug. 27, 1999

(51) Int. Cl.[7] ..... H04R 25/00
(52) U.S. Cl. ..... 381/396; 381/96; 381/353
(58) Field of Search ..... 381/353, 96, 386, 381/59, 412, 413, 426, FOR 159, 94.1, 354

(56) References Cited

U.S. PATENT DOCUMENTS

| | | | | |
|---|---|---|---|---|
| 4,715,559 | | 12/1987 | Fuller | 244/1 |
| 5,332,061 | | 7/1994 | Majeed et al. | 180/312 |
| 5,526,292 | | 6/1996 | Hodgson et al. | 364/574 |
| 5,586,195 | * | 12/1996 | Ishigaki et al. | 381/386 |
| 5,812,686 | * | 9/1998 | Hobelsberger | 381/96 |
| 5,845,236 | | 12/1998 | Jolly et al. | 702/195 |

FOREIGN PATENT DOCUMENTS

| | | | | |
|---|---|---|---|---|
| 3524280 | * | 1/1987 | (DE) | 381/96 |

OTHER PUBLICATIONS

Fuller, C. R., et. al., "Experiments on Reduction of Aircraft Interior Noise Using Active Control of Fuselage Vibrations," *J. Acoust. Soc. Am.*, 78(S1), S79, 1985.

Fuller, C. R., et. al., "Active Control of Sound Transmission/Radiation from Elastic Plates by Vibrational Inputs," *J. Sound and Vibration*, 136(1), pp. 1–15, 1990.

Bies, D., and Hansen, C., Engineering Noise Control, Theory and Practice, E&FN SPON, 2nd edition, NY, 1996.

Cazzolato, B., Novel Transduction Methods for Active Control of Sound Transmission into Enclosures. Ph.D. Dissertation, University of Adelaide, 1998.

* cited by examiner

*Primary Examiner*—Huyen Le
(74) *Attorney, Agent, or Firm*—Kenneth E. Callahan

(57) ABSTRACT

This invention presents a passive vibroacoustic device that serves the dual function of attenuating the vibration of a flexible structure, and providing acoustic dissipation to the volume or cavity enclosed by the structure. This reduces the transmission of sound from external sources into the enclosure, and reduces vibration of the structure. By design of the shunting resistor and the mass and suspension properties, the device can be optimized to achieve high levels of both structural vibration attenuation and acoustic attenuation. Incorporating a feedback loop or adaptation mechanism will permit the device to maintain optimum attenuation in the case of time varying systems.

5 Claims, 12 Drawing Sheets

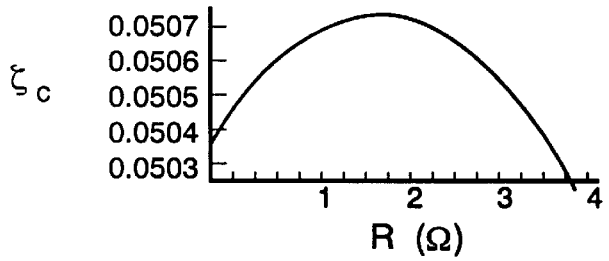

*Fig. 11*

| Parameter | Symbol | Value |
|---|---|---|
| sound speed | $c$ | 340 m/s |
| air density | $\rho$ | 1.23 kg/m$^3$ |
| mass of base structure | $m_1$ | .5 kg |
| mass of magnet | $m_2$ | 2.2 kg |
| mass of diaphragm and coil | $m_3$ | .2 kg |
| damping ratio of base structure | $\zeta_1$ | .02 |
| damping ratio of magnet suspension | $\zeta_2$ | .20 |
| damping ratio of diaphragm suspension | $\zeta_3$ | .20 |
| uncoupled resonant frequency of base structure | $f_1$ | 80 Hz |
| uncoupled resonant frequency of magnet and magnet suspension | $f_2$ | 40 Hz |
| uncoupled resonant frequency of diaphragm and diaphragm suspension | $f_3$ | 100 Hz |
| area of acoustic cavity and diaphragm | $A$ | .0314 m$^2$ |
| length of acoustic cavity | $l$ | 2.125 m |

*Fig. 12*

PASSIVE VIBROACOUSTIC ATTENUATOR FOR STRUCTURAL ACOUSTIC CONTROL

STATEMENT OF GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

BACKGROUND OF THE INVENTION

1. Field of the Invention

The proposed invention is related to the field of structural vibration and acoustic (noise) control.

2. Description of the Prior Art

A number of engineering applications can be described as a flexible structure surrounding a cavity. In these systems, structural vibrations induced by either force inputs or external acoustic pressure loads produce sound (or noise) within the cavity. Some common examples of acoustic cavities enclosed by a flexible structure include airplanes, trains, cars and spacecraft launch vehicles. A subset of this group of applications is civil structures or buildings, where relatively rigid walls are combined with flexible windows and other panels.

For the case of spacecraft launch vehicle fairings, the structure is typically constructed from a stiff composite material. The launch vehicle fairing is subjected to extremely high levels of structural vibration and noise at launch. This vibration and noise can damage delicate payloads. The acoustic response of the volume enclosed by the flexible composite structure is dominated at low frequency by very lightly-damped structural acoustic modes (50 Hz–250 Hz). In spacecraft applications, mass and volume are critical parameters, therefore there is a budget on how much noise treatment can be added to the fairing in order to mitigate noise and vibration. Passive methods for attenuating low-frequency disturbances such as foam linings and acoustic blankets are not effective at low frequency. Furthermore, they provide negligible structural vibration attenuation.

Active control strategies have been applied to reduce noise inside acoustic cavities such as aircraft fuselages and automobiles, and have demonstrated significant success in coupling to and attenuating low-frequency acoustic modes. (Fuller, C. R., et. al., "Experiments on Reduction of Aircraft Interior Noise Using Active Control of Fuselage Vibrations," *J. Acoust. Soc. Am.,* 78(S1), S79, 1985; Fuller, C. R., et. al., "Active Control of Sound Transmission/Radiation from Elastic Plates by Vibrational Inputs," *J. Sound and Vibration,* 136(1), pp. 1–15, 1990). However, these strategies have the disadvantage of requiring complex control algorithms, digital signal processing hardware, power amplifiers, signal conditioning, and extensive cabling, which greatly increases the mass of the system. In addition, active acoustic control techniques do little to reduce the vibration of the structure or to prevent noise from being transmitted through the structure. Finally these techniques have never been demonstrated at acoustic levels commensurate with space launch.

There are several accepted methods of reducing noise transmission from external sources into a cavity interior. Most methods are designed to reduce structural vibration by increasing the mass, stiffness or damping of the structure. Traditional, localized, reactive vibration-suppression devices such as vibration absorbers and tuned mass-dampers are very effective at increasing localized structural impedance and structural damping, respectively. (Bies, D., and Hansen, C., *Engineering Noise Control, Theory and Practice*, E&FN SPON, 2$^{nd}$ edition, NY, 1996). The disadvantage of such devices is the necessity of additional mass for their operation. Furthermore, these devices act only on the structure, and do little to attenuate the acoustic dynamics of the cavity.

Recently, work has been done to combine active structural control with active acoustic control. (Jolly et. al., *Hybrid Active-Passive Noise and Vibration Control System for Aircraft*, U.S. Pat. No. 5,845,236, 1998; Fuller, C. R., *Apparatus and Method for Global Noise Reduction*, U.S. Pat. No. 4,715,559, 1987; Hodgson, et. al., *Broadband Noise and Vibration Reduction*, U.S. Pat. No. 5,526,292, 1996; Majeed et. al., *Active Vibration Control System for Attenuation Engine Generated Vibrations in a Vehicle*, U.S. Pat. No. 5,332,061, 1994). These methods utilize arrays of structural sensors such as accelerometers, and acoustic sensors such as microphones to sense disturbances and actively cancel them. Typically in these control systems, loudspeakers are driven by a control signal 180° out-of-phase with the sensed disturbance to provide cancellation. Also, active vibration absorbers, passive vibration absorbers, or structural actuators such as proof-mass actuators, piezoceramic actuators, or shakers, are used by the control scheme to control structural vibration. Although these active methods have been successful at reducing structural vibration and interior noise, they require a considerable degree of sophistication and hardware to implement. The mass of the hardware (including actuators, sensors, controllers, signal conditioning hardware, power amplifiers, mounting apparatus, and cabling) can become prohibitively large and negate the value of using such systems. Furthermore, complex control systems such as these have a greater chance of component failure, which can be catastrophic in critical applications.

SUMMARY OF THE INVENTION

The passive vibroacoustic device of the present invention consists of an acoustic diaphragm, a voice-coil, a magnet, a shunting resistor, and a base suspension. Within a flexible structure surrounding a cavity, the device operates to both reduce the structural vibration by increasing the mechanical impedance of the flexible structure and to dissipate acoustic energy in the cavity. The vibroacoustic attenuating device has numerous advantages over active vibration absorbers. It is completely passive in nature, not requiring cabling, power amplifiers, signal conditioning hardware, or centralized control schemes. The device is capable of coupling to and dissipating low-frequency acoustic modes of a cavity. It also acts as a collocated structural vibration damper and couples to and dissipates structural vibration modes. Unlike tuned vibration absorbers and similar devices which have a narrow targeted bandwidth of attenuation, this device targets multiple structural modes and acts over a wider bandwidth.

Furthermore, there is no possibility of instability or catastrophic failure since the device is completely passive. It is much less expensive to produce and more easily implemented than fully-active and hybrid control systems of the prior art. This device can easily be added onto existing spacecraft fairing structures without requiring redesign of the fairing. The added mass contributed by the device itself serves to attenuate both structural vibration and the acoustic cavity modes, providing more efficient use of the added mass.

The advantages offered by this invention and further novel details and features of this device will become readily apparent from the subsequent description and drawings of the preferred embodiment.

BRIEF DESCRIPTION OF THE DRAWINGS

FIG. 11 is a plot of the damping ratio of the acoustic cavity mode as a function of shunt resistance using the model presented in FIG. 4.

FIG. 12 is a table of the parameters used in the example shown in FIG. 4.

DESCRIPTION OF THE PREFERRED EMBODIMENT

The present invention has the advantage that it both reduces structural vibration by increasing the mechanical impedance of the flexible structure and dissipates acoustic energy in the cavity. In its most basic implementation, the impedance that this device adds to the structure is structural damping, but it also can be used as a tuned vibration absorber, which adds localized stiffness in a narrow frequency band, depending on the application. Through the shunted voice-coil loudspeaker, the device provides low frequency acoustic dissipation with almost no added weight or complexity. More efficient use of the additional mass contributed by the device is achieved by simultaneous use of the magnet (which constitutes most of the mass) to attenuate both structural vibration and acoustic energy. This is a key feature of this invention.

The present invention acts as a stand-alone device and requires no cabling, digital signal processing, or signal conditioning which is required in active control approaches. It is intended as an add-on treatment for a structure with noise or vibration problems, and requires no redesign of the structural-acoustic system. Since it is entirely passive, it requires no external power source.

Figure 1:
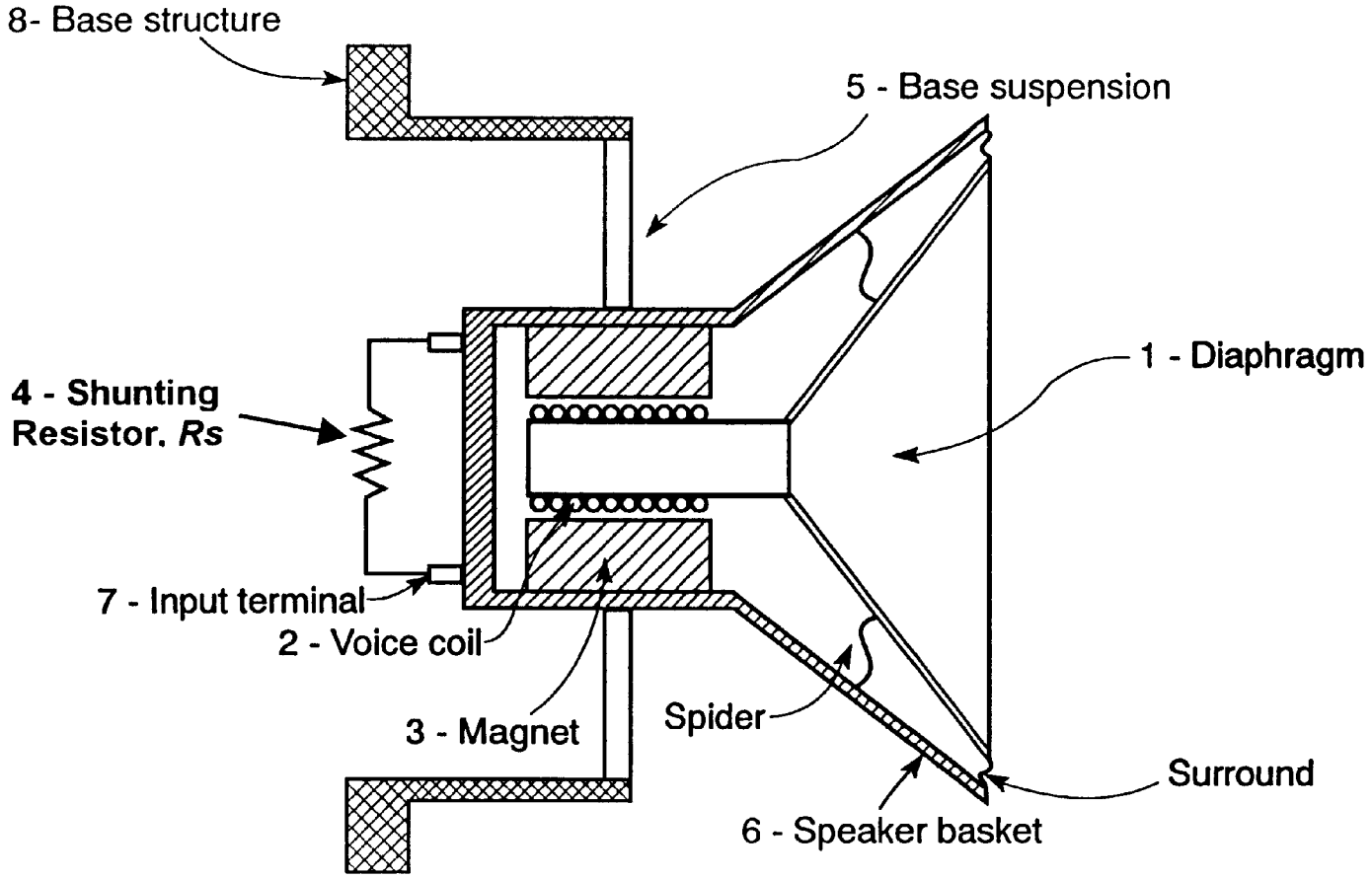
FIG. 1 is a schematic diagram of the invention.

The key components of this invention are an acoustic diaphragm 1, a voice-coil 2, a magnet 3, a shunting resistor 4, and a base suspension 5. A schematic diagram of one embodiment of the device is shown in FIG. 1. The speaker basket 6 encloses the voice coil 2 and magnet 3 in a cylindrical base section and the diaphragm in its conical section. The shunt resister 4 is connected across the input terminals 7 of the loudspeaker and hence to the voice coil. A base structure 8 is rigidly attached to the flexible structure enclosing a cavity. The base suspension connects the cylindrical base section of the speaker basket 6 to the base structure 8.

Figure 2:
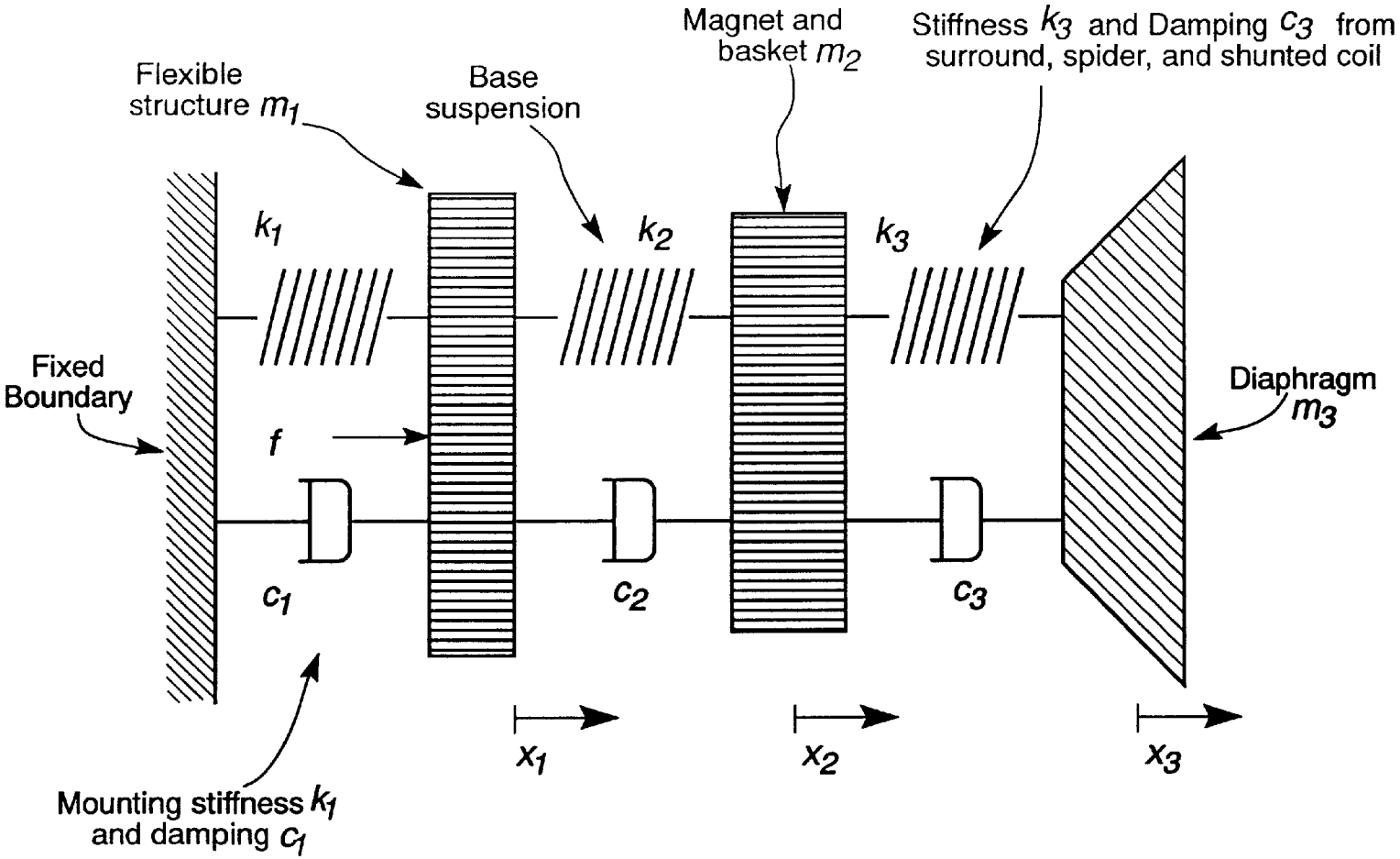
FIG. 2 shows a lumped-parameter model of the invention including the flexible structure with force input, $f$.

FIG. 2 presents a lumped parameter model of the system using spring, mass, and damper elements. The moving mass of the diaphragm, $m_3$, is attached to the speaker basket by the spider and surround elements which provide stiffness $k_3$ and damping $c_3$. The mass of the speaker basket and the magnet constitute $m_2$ shown in FIG. 2. The combined mass, $m_2$, is attached to the base structure by the base suspension, which contributes additional stiffness and damping parameters, $k_2$ and $c_2$, respectively. In FIG. 2, the device is attached to a flexible structure represented by ml, which is subjected to a force input, $f$. The flexible structure inherently has internal stiffness and damping properties, which are represented as $k_1$ and $c_1$ attached to ground. The shunting resistor, $R_s$, is applied to the input terminals of the voice coil, which increases the dissipation of mechanical/acoustic energy, and is a key feature of this invention. The shunting resistor, $R_s$, allows the damping characteristics of the mechanical-acoustic interface to be varied to achieve optimum coupling and acoustic dissipation.

Figure 3:
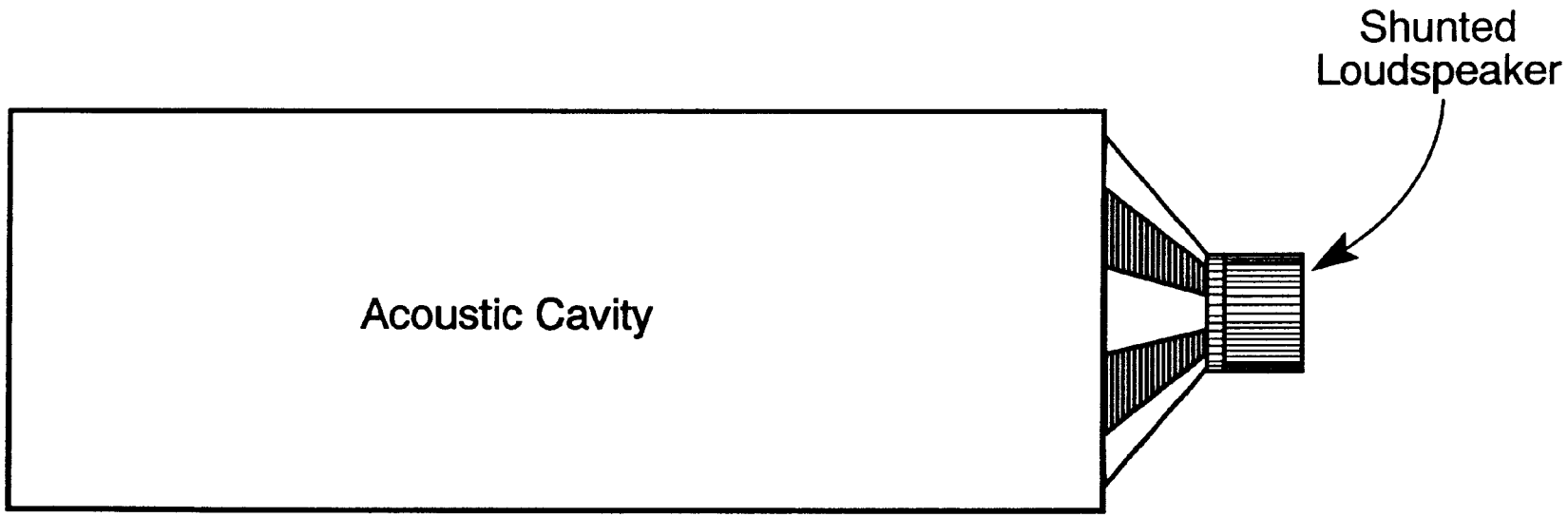
FIG. 3 shows an acoustic cavity with an attached shunted loudspeaker.

The diaphragm and voice-coil, designated by $m_3$, $c_3$ and $k_3$ in FIG. 2, have the same dynamics as a traditional loudspeaker. What is different from a traditional loudspeaker is the addition of a shunt resistor in place of the external voltage input. If just the diaphragm, shunted voice-coil, and magnet were added to the end of an acoustic cavity, as shown in FIG. 3, the dynamics of the coupled systems can be described by the following set of coupled differential equations:

$$\ddot{x}_3 = -\omega_3^2 x_3 - \frac{\left(c_2 + \frac{(bl)^2}{R_s + R}\right)}{m_3}\dot{x}_3 - \frac{A}{m_3}\dot{r} \tag{1}$$

$$\ddot{r} = \frac{2\rho c\omega_c}{\pi}\dot{x}_3 - \omega_c^2 r$$

$$p = \dot{r}$$

where $\omega_3$ is the uncoupled resonant frequency of the loudspeaker, $c_3$ represents the damping due to the suspension of the speaker diaphragm, b is the magnetic field strength, l is the length of the voice-coil, R is the resistance of the coil, $R_s$ is the resistance of the shunt resistor, A is the cross-sectional area of the acoustic cavity, $m_3$ is the mass of the diaphragm and coil, ρ is the density of air, c is the speed of sound in air, $\omega_c$ is the fundamental resonance of the uncoupled acoustic cavity (assuming rigid-wall boundary conditions), and p is the acoustic pressure directly in front of the diaphragm. In Equation (1), only the first mode of the cavity is considered and the inductance of the voice-coil is neglected since only low frequency operation is of interest. Equation (1) shows that the equivalent damping in the loudspeaker can be represented as $$c_2' = c_2 + \frac{(Bl)^2}{R_s + R}. \tag{2}$$

It is apparent that the value of damping can be controlled by changing the value of the shunting resistor. The maximum value of damping in the loudspeaker will be achieved when the resistance is zero (shorted), but can be adjusted to achieve maximum coupling with incident acoustic pressure.

Figure 4:
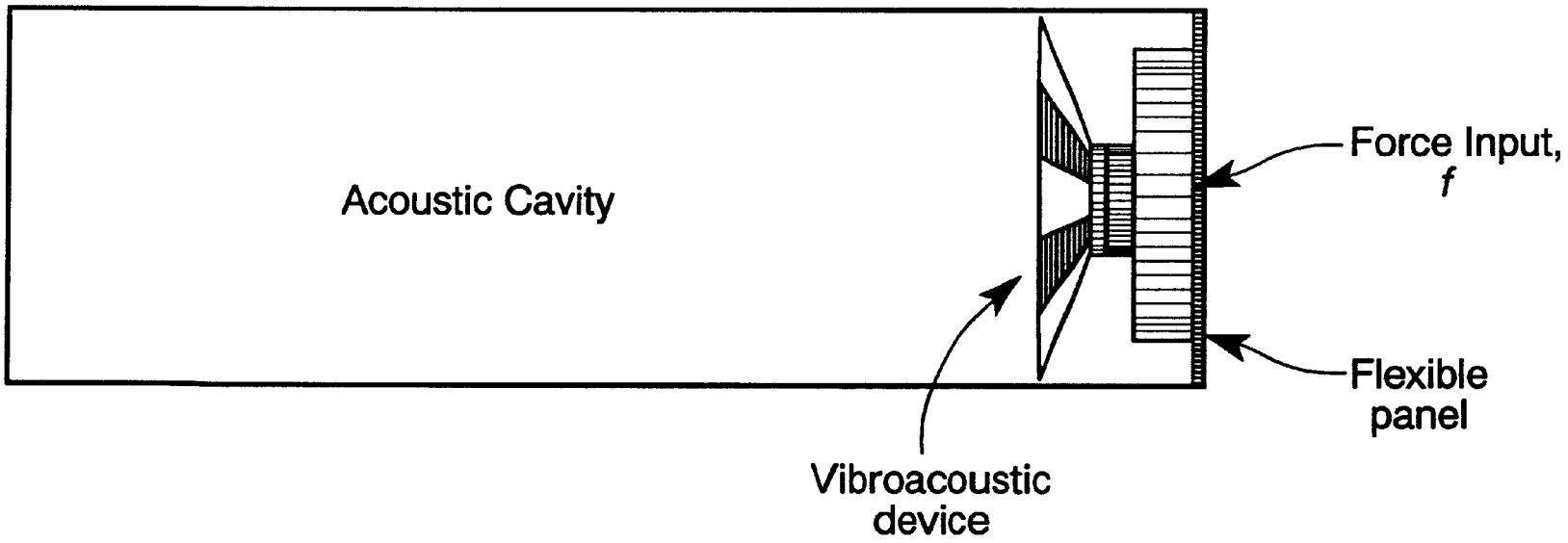
FIG. 4 shows an acoustic cavity terminated with a flexible panel with an attached vibroacoustic attenuator.

Now consider an acoustic enclosure terminated at one end by a flexible panel with the proposed vibroacoustic device attached to the panel as shown in FIG. 4. Assume a disturbance acts on the panel and can be presented as a force input, $f$, to the panel. This disturbance results in vibration which excites acoustic waves within the acoustic cavity. However, if the device suspension, designated in FIG. 2 by $k_2$ and $c_2$, is heavily damped and the mass is tuned so that the suspension participates in the motion of the base structure, damping is added to the base structure. This damping impedes the motion of the flexible panel, and combines with the added dissipation in the acoustic cavity due to the acoustic diaphragm to reduce noise transmission. The amount of added damping depends on the selection of the mass and suspension stiffness. If the frequency of the device is coincident or nearly coincident with the frequency of the dominant mode of vibration of the flexible panel, a tuned mass-damper results and a maximum amount of damping is added to the individual structural mode. (Bies, D., and Hansen, C., *Engineering Noise Control, theory and practice*, E&FN SPON, $2^{nd}$ edition, NY, 1996). In the preferred embodiment of the vibroacoustic device, the frequency is set below all of the structural modes of interest. This insures participation of the device and added damping in many structural modes. If the vibroacoustic device is added to the end of an acoustic cavity as shown in FIG. 4, the behavior of the device coupled with the acoustic cavity can be described by the following set of coupled differential equations:

$$\eta_1=-\omega_1^2\eta_1-2\zeta_1\omega_1\dot{\eta}_1+\psi_{13}(f-A\dot{r})$$

$$\dot{\eta}_2=-\omega_2^2\eta_2-2\zeta_2\omega_2\dot{\eta}_2+\psi_{23}(f-A\dot{r})$$

$$\eta_3=-\omega_3^2\eta_3-2\zeta_3\omega_3\dot{\eta}_3+\psi_{33}(\zeta-A\dot{r})$$

$$\ddot{r}=B(\psi_{13}\dot{\eta}_1\psi_{23}\dot{\eta}_2+\psi_{33}\dot{\eta}_3)-\omega_c^2 r$$

$$p=\dot{r} \tag{3}$$

where $$B=\frac{2\rho c\omega_c}{\pi},$$

are the structural modal degrees of freedom and $\psi_{ij}$ are components of the $i^{th}$ mode shape corresponding to the $j^{th}$ position.

Figure 5:
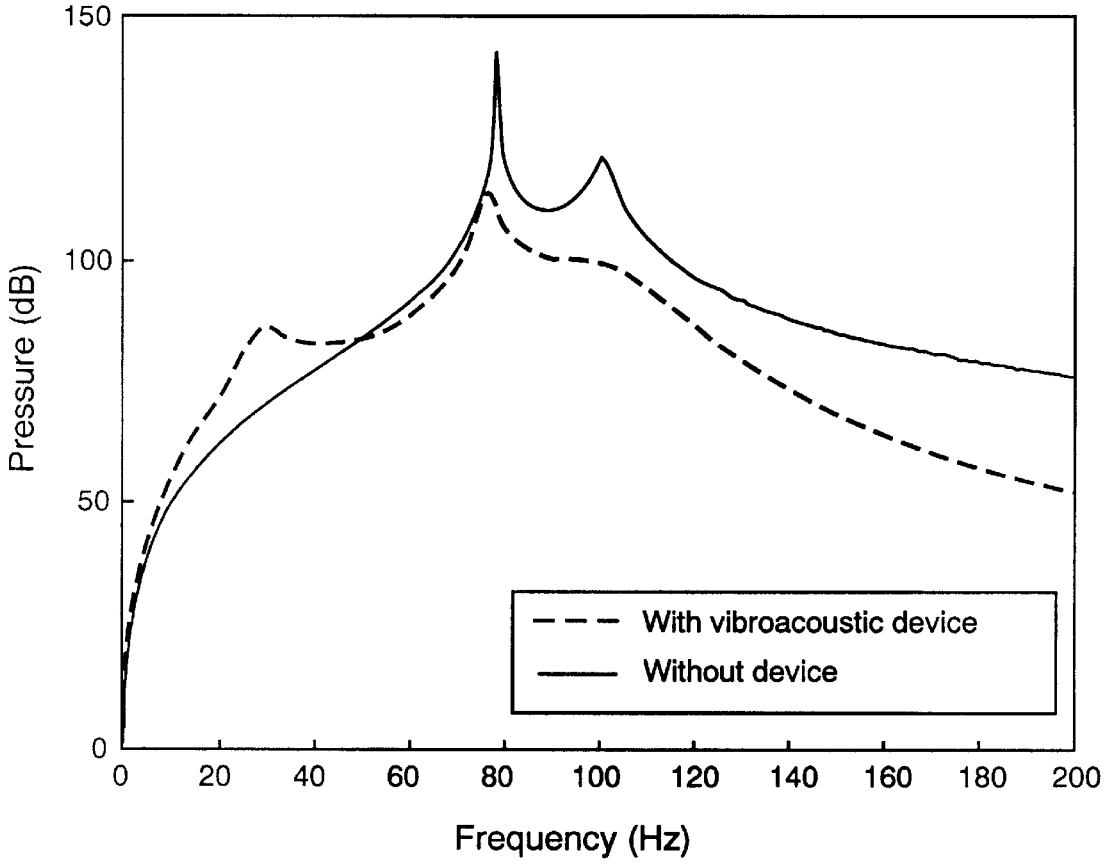
FIG. 5 is a plot of the pressure response in an acoustic cavity as a result of panel vibration with and without the vibroacoustic device.

For a cylindrical duct of length 2.125 m, and using realistic values of mass, damping, stiffness and electromagnetic properties, the pressure response in a cavity for a broadband unit force input into the panel is shown in FIG. 5 with and without the vibroacoustic device present. In this case, the vibroacoustic device reduces the overall sound pressure level by over 24 dB in the bandwidth from 0 to 200 Hz. This corresponds to an RMS pressure amplitude with the device of less than 0.4% of the RMS pressure amplitude without the device. The specific parameters used in this example are given in the table of FIG. 12.

Figure 6:
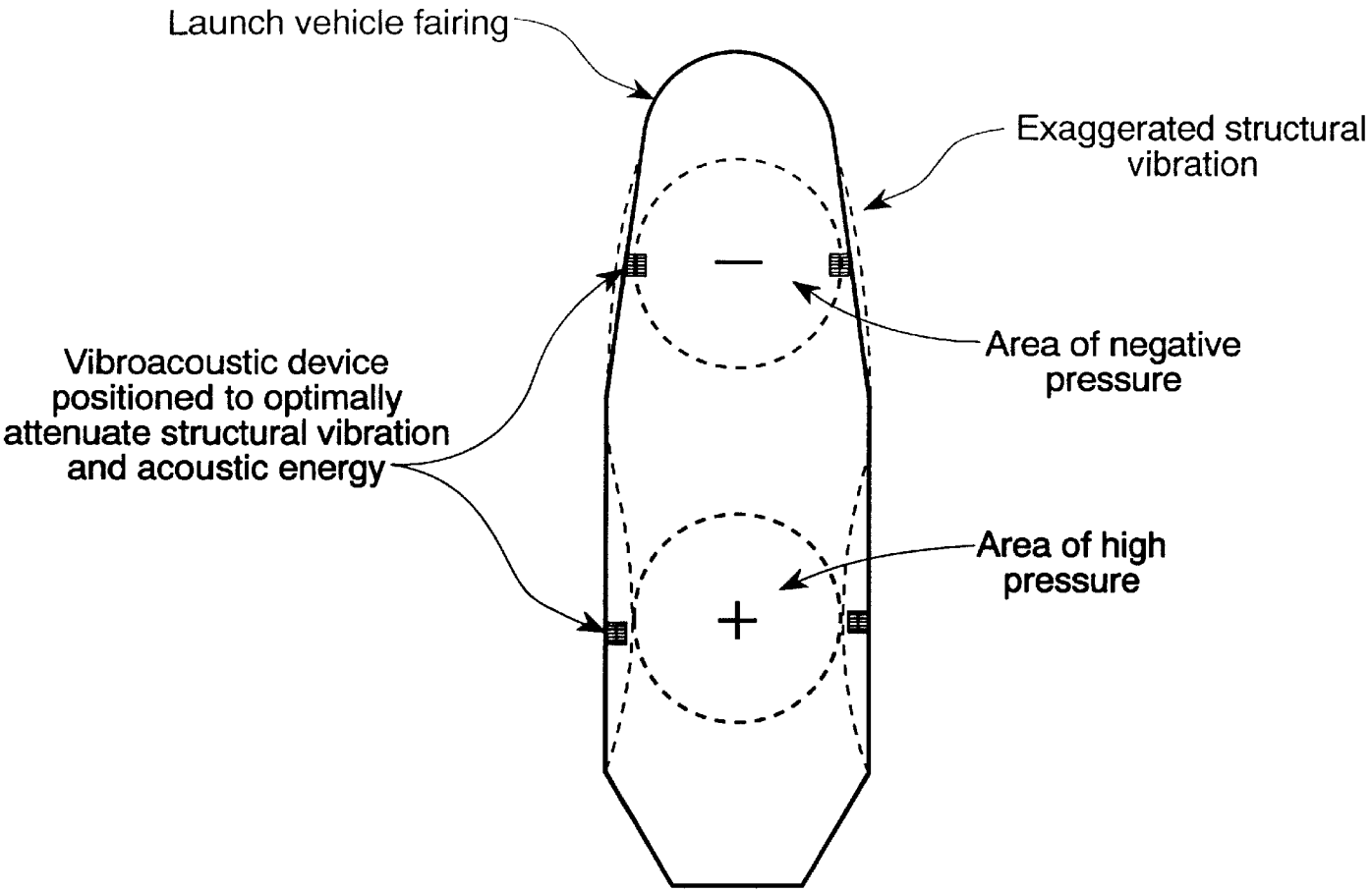
FIG. 6 illustrates the optimal positioning of vibroacoustic devices to attenuate structural vibration and acoustic response of a spacecraft fairing structure.

In more complicated structures, this same result can be generalized to get the same effect. The specific parameters of the vibroacoustic device can be tuned for the best performance for specific applications. Another added benefit of the device in more complicated structures comes from the observation that locations of high acoustic pressure on the interior of the cavity usually correspond with locations of large structural motion which is responsible for sound transmission. (Cazzolato, B., *Novel Transduction Methods for Active Control of sound Transmission into Enclosures*. Ph.D. Dissertation, University of Adelaide, 1998). In consideration of this, implementing a small number of the vibroacoustic devices in these optimum locations, as shown FIG. 6, would be extremely effective in reducing noise transmission in relatively large, complicated systems. The device's unique characteristic of adding both structural damping and acoustic dissipation in an optimal way at relatively few locations greatly simplifies its use and integration as compared to prior art.

Figure 7:
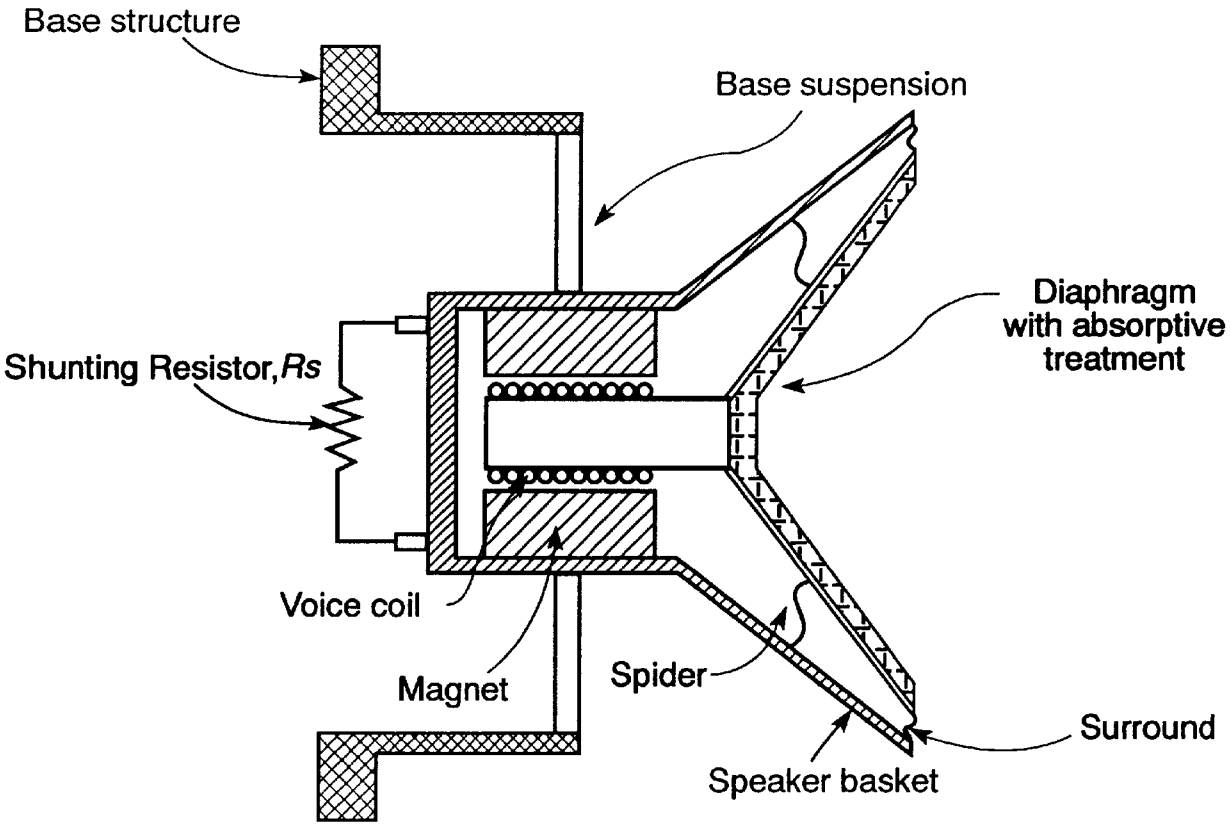
FIG. 7 is a schematic diagram of an alternate embodiment of the vibroacoustic device with absorptive treatment added to the diaphragm.

Since the acoustic enclosure is coupled to the structure through the loudspeaker, damping in the loudspeaker will translate into dissipation of acoustic energy in the cavity. This effect is similar to adding foam which makes the cavity less reverberant, but has the potential for dissipating acoustic energy at low frequency where foam is ineffective. As an additional embodiment, foam can be adhered to the surface of the diaphragm to get additional attenuation at high frequency as shown in FIG. 7. The resulting device will then be capable of increased attenuation over a broader frequency range than possible from using either foam or the device individually.

Figure 8:
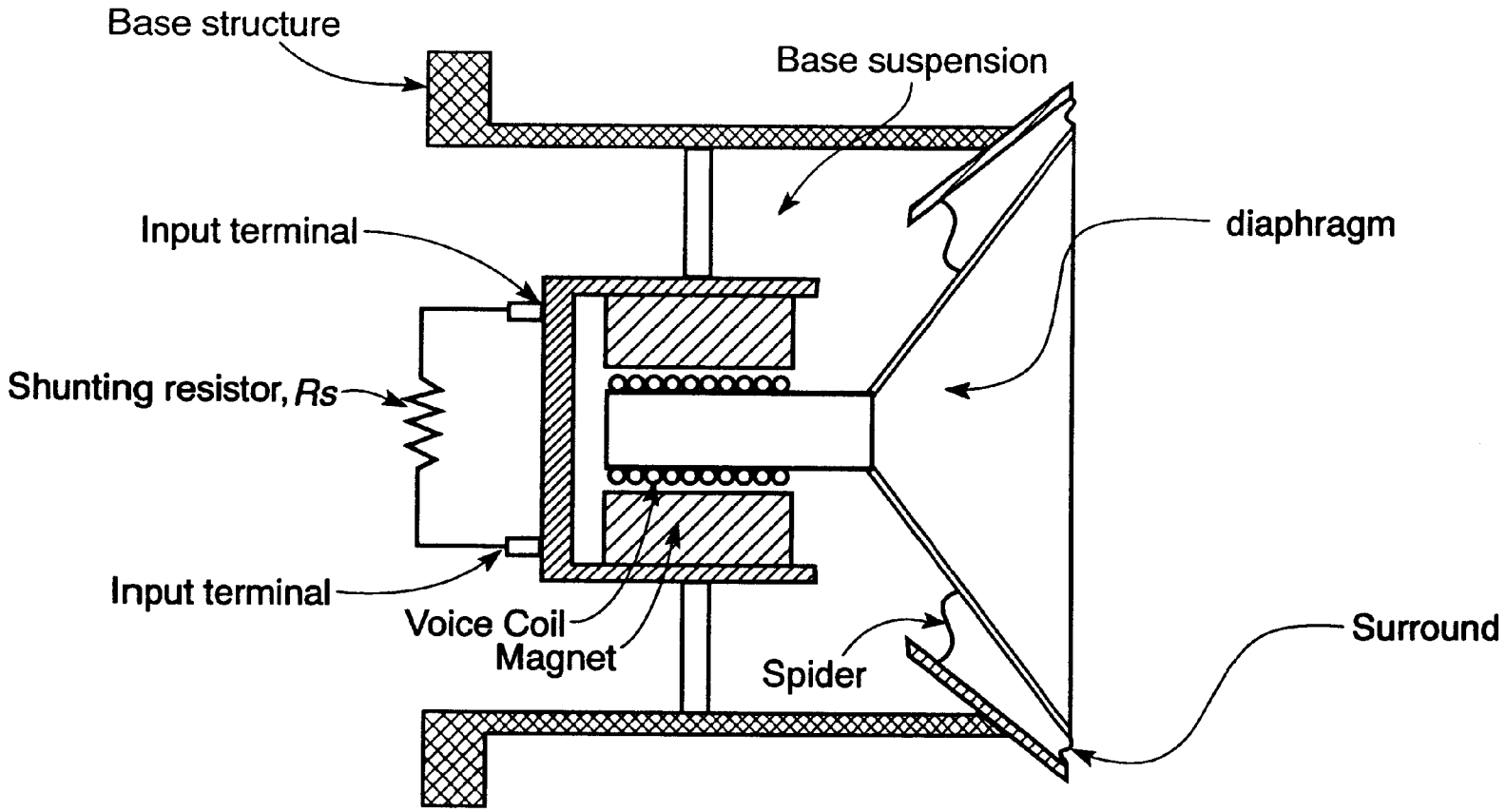
FIG. 8 is a schematic diagram of an alternate embodiment of invention with the speaker basket attached to the base structure.
Figure 9:
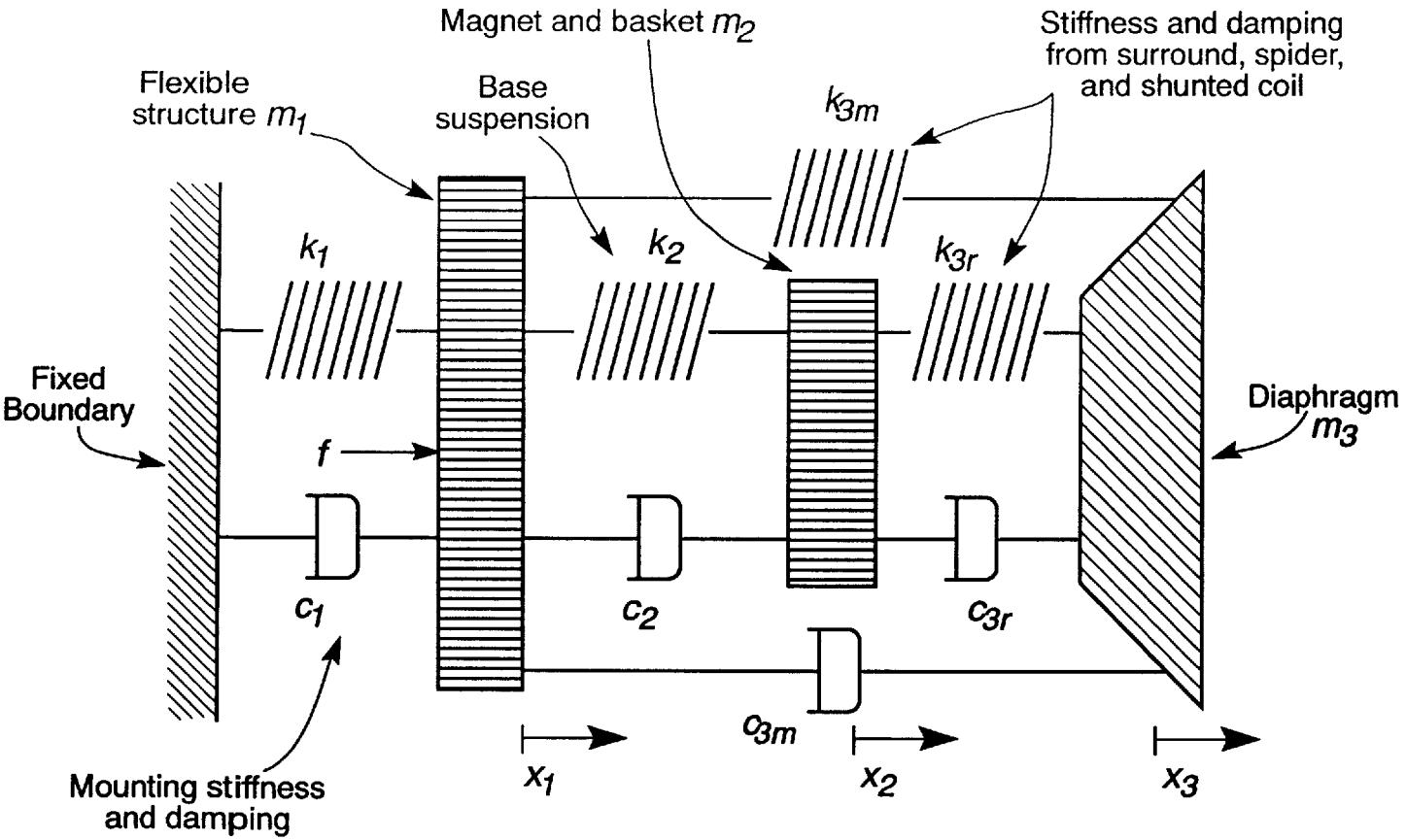
FIG. 9 is a lumped-parameter representation of the alternate embodiment presented in FIG. 8.

Another embodiment of the proposed invention is presented in FIG. 8 and FIG. 9. In this implementation, the suspension of the acoustic diaphragm is connected to the vibrating base structure, but still derives damping induced from the shunted voice-coil through the relative motion between the diaphragm and the magnet. In some applications, this implementation may result in better performance. The resulting effective stiffness and damping is indicated in the lumped parameter model shown in FIG. 9 as $k_{3r}$, $k_{3m}$, $c_{3r}$, and $c_{3m}$. Each parameter can be designed to yield the best performance for the particular application.

Figure 10:
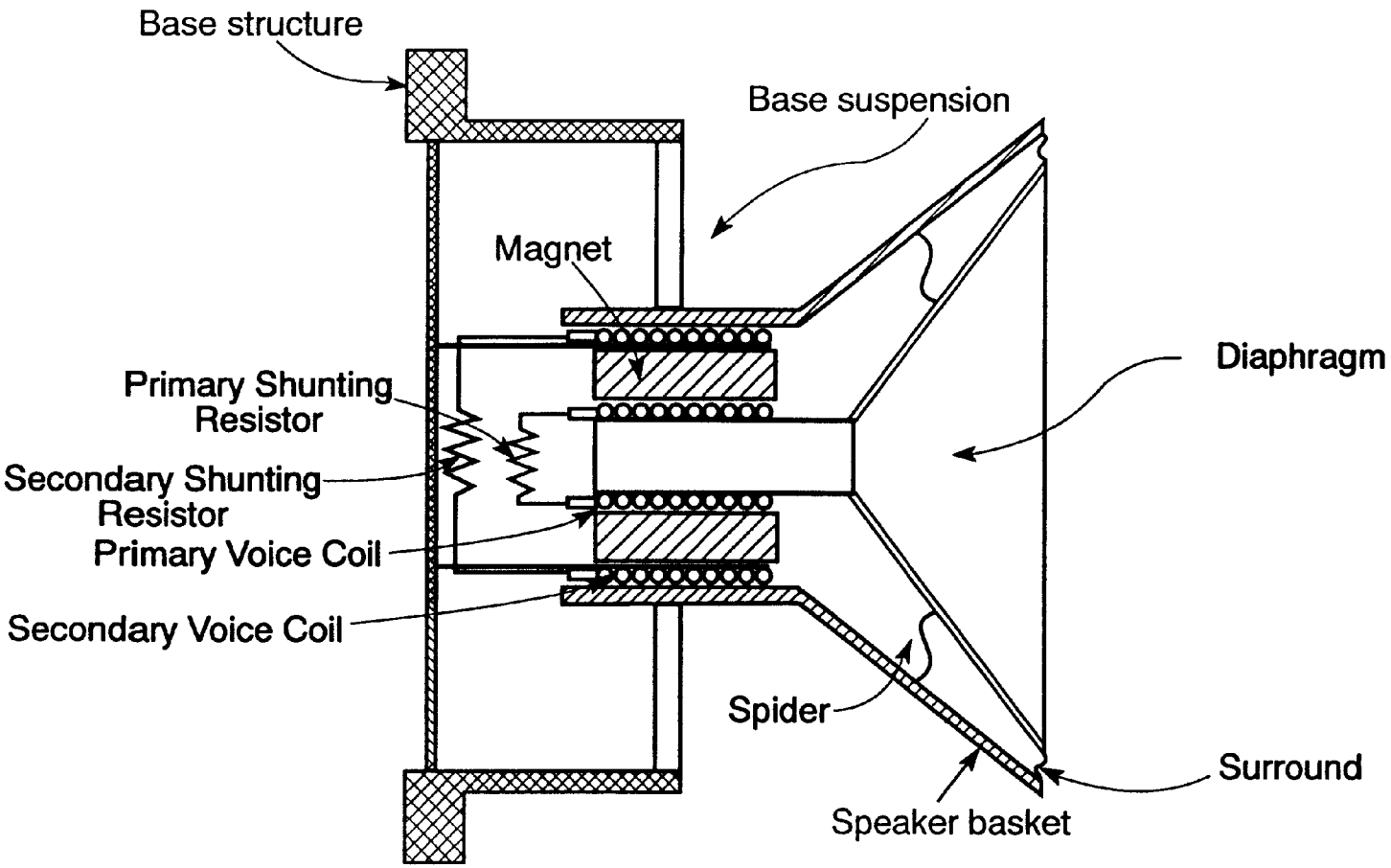
FIG. 10 is a further embodiment using a secondary shunted voice coil attached to the base structure.

Another possible embodiment of this invention is the inclusion of a secondary shunted voice-coil that is fixed to the base structure- as shown in FIG. 10. The interaction of the secondary voice-coil and the magnet influences the effective damping of the magnet's suspension. Through the design of the secondary voice-coil, the damping of the magnetic suspension can be varied to best suit the particular application.

Figure 13:
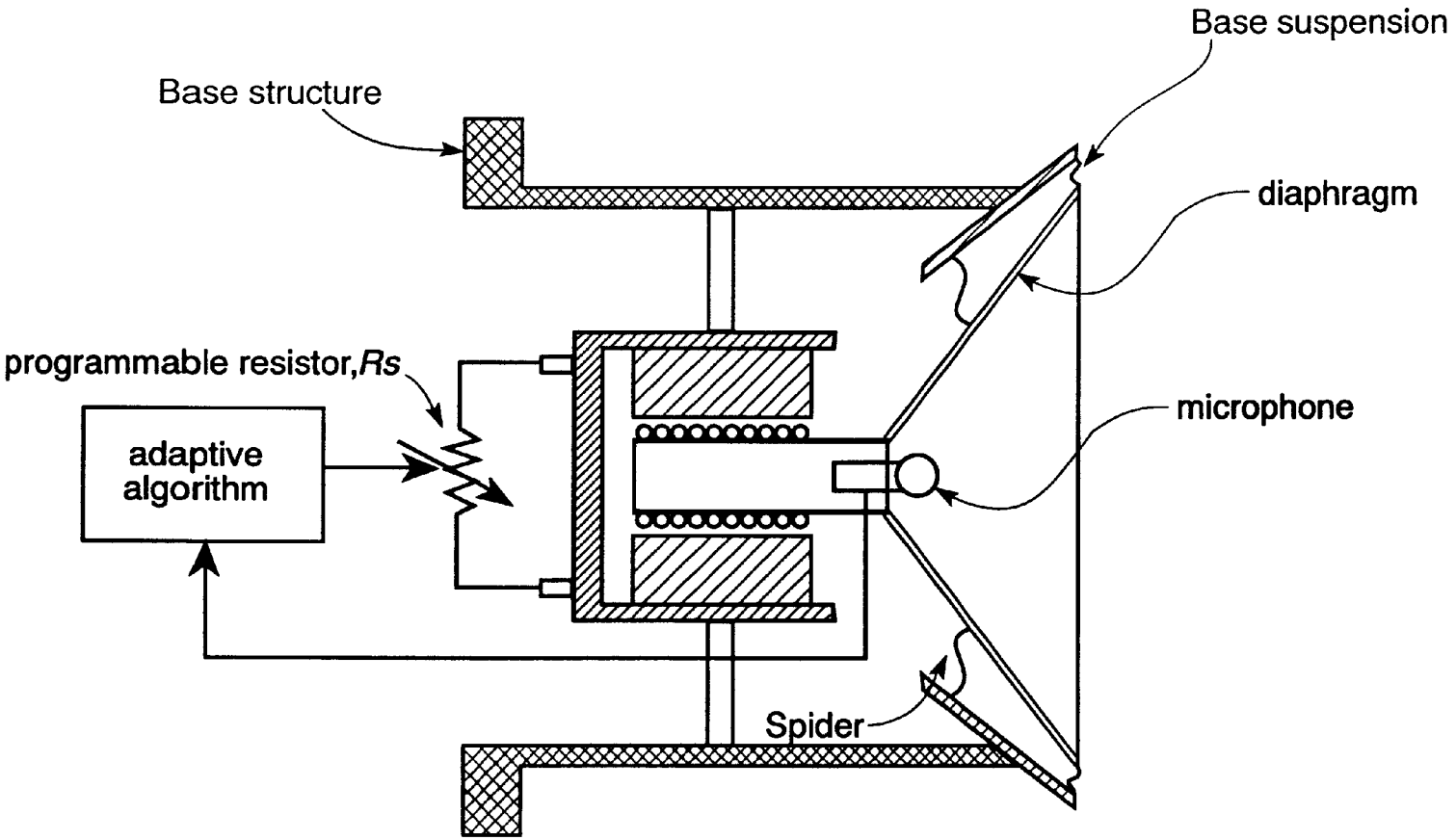
FIG. 13 is a schematic diagram of an alternate embodiment of the invention showing a programmable resistor with a feedback loop and microphone.

An additional embodiment of the proposed invention allows for adaptation of the damping characteristics in order to optimize acoustic dissipation. Since the dissipation of the internal cavity is coupled to the damping of the mechanical device which is directly related to the shunt resistor, a variable shunt resistor could be implemented to maximize cavity dissipation for a given application. The implementation of this would involve a programmable shunt resistor in a feedback loop with a microphone at the surface of the acoustic diaphragm. A control law could be designed which varied the shunt resistor to a value that minimized pressure on the surface. An illustration of the effectiveness of such an adaptive scheme is presented in FIG. 11 using the previously described example. In FIG. 11, the variation of the damping ratio of the cavity mode, $\zeta_c$, is plotted with respect to shunting resistance. In this case, adaptation of the shunt resistor to around 1.9 Ω maximizes dissipation in the cavity. The addition of an adaptation mechanism would require very little power since a programmable shunt resistor is a digital device, as would be the control electronics. The microphone and associated signal conditioning would also be very low power. For instance, the power requirements of the entire adaptation circuit would be much less than that of a cellular phone, which contains all of the required components and many more for operation. Furthermore, since the adaptation mechanism only affects the shunting resistor, the device is still considered a passive absorber, as opposed to an active control device. A schematic diagram of this embodiment is shown in FIG. 13.

We claim:

1. A passive device for attenuating structural vibrations of a flexible structure surrounding a cavity while simultaneously providing acoustic dissipation to the interior volume of the cavity, said device comprising;

(a) a loudspeaker comprised of a speaker basket enclosing a voice coil and a magnet in its base section and further enclosing a diaphragm, spider, and surround in its conical section;

(b) a base structure rigidly attached to said flexible structure;

(c) a base suspension structure connecting the base section of said speaker basket to said base structure, whereby stiffness and damping attributes of said base suspension structure cause vibrations of said flexible structure to be absorbed;

(d) a shunting resistor connected to the voice coil of said loudspeaker that allows the damping characteristics of the mechanical-acoustic interface of said loudspeaker to be varied to achieve optimum coupling and acoustic dissipation within the interior volume of said cavity.

2. The passive device of claim 1, wherein said diaphragm is coated with sound absorbent material to obtain additional acoustic attenuation at high frequencies.

3. The passive device of claim 1, wherein said base structure is extended to directly connect to the diaphragm suspension of said speaker basket.

4. The passive device of claim 1, wherein a shunted secondary voice coil wound about the outer surface of the magnet and fixed to the base structure is employed.

5. The passive device of claim 1, wherein a programmable shunt resistor is used in a feedback loop with a microphone located on the diaphragm, such that the acoustic dissipation within the cavity can be optimized as conditions vary.

* * * * *